US006951836B2

(12) United States Patent
Jahns et al.

(10) Patent No.: US 6,951,836 B2
(45) Date of Patent: Oct. 4, 2005

(54) MICROCAPSULE PREPARATIONS AND DETERGENTS AND CLEANING AGENTS CONTAINING MICROCAPSULES

(75) Inventors: Ekkehard Jahns, Weinheim (DE); Dieter Boeckh, Limburgerhof (DE); Werner Bertleff, Viernheim (DE); Peter Neumann, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 208 days.

(21) Appl. No.: 10/169,075

(22) PCT Filed: Jan. 4, 2001

(86) PCT No.: PCT/EP01/00048

§ 371 (c)(1),
(2), (4) Date: Nov. 8, 2002

(87) PCT Pub. No.: WO01/49817

PCT Pub. Date: Jul. 12, 2001

(65) Prior Publication Data

US 2003/0125222 A1 Jul. 3, 2003

(30) Foreign Application Priority Data

Jan. 5, 2000 (DE) ..... 100 00 223

(51) Int. Cl.[7] ..... C11D 3/37; C11D 3/50; C11D 17/00

(52) U.S. Cl. ..... 510/441; 510/101; 510/119; 510/143; 510/349; 510/361; 510/476; 510/499

(58) Field of Search ..... 510/101, 119, 510/143, 349, 361, 441, 476, 499

(56) References Cited

U.S. PATENT DOCUMENTS

| | | | | | |
|---|---|---|---|---|---|
| 4,251,386 | A | | 2/1981 | Saeki et al. | |
| 4,406,816 | A | | 9/1983 | Sliwka | |
| 4,574,110 | A | | 3/1986 | Asano et al. | |
| 4,898,696 | A | * | 2/1990 | Sliwka | 264/4.7 |
| 5,596,051 | A | | 1/1997 | Jahns et al. | |
| 6,194,375 | B1 | * | 2/2001 | Ness et al. | 512/4 |

FOREIGN PATENT DOCUMENTS

| | | | | |
|---|---|---|---|---|
| EP | 0 457 154 | | 11/1991 | |
| EP | WO 99/38946 | * | 8/1999 | C11D/3/50 |
| FR | 2 774 390 | | 8/1999 | |
| WO | 01 04257 | | 1/2001 | |

* cited by examiner

*Primary Examiner*—Brian P. Mruk
(74) *Attorney, Agent, or Firm*—Oblon, Spivak, McClelland, Maier & Neustadt, P.C.

(57) ABSTRACT

Described are microcapsule formulations comprising microcapsules having a core of a hydrophobic material, which encloses at least one fragrance or perfume, and a capsule shell which is obtainable by either i) free-radical polymerization of ethylenically unsaturated monomers comprising:

from 30 to 100% by weight of one or more $C_1$–$C_{24}$ alkyl esters of acrylic and/or methacrylic acid, from 0 to 70% by weight of a bi- or polyfunctional monomer, from 0 to 40% by weight of other monomers; or ii) acid-induced condensation of melamine-formaldehyde precondensates and/or their $C_1$–$C_4$ alkyl ethers.

Also described are laundry detergent or cleaning product compositions which comprise the microcapsules.

20 Claims, No Drawings

MICROCAPSULE PREPARATIONS AND DETERGENTS AND CLEANING AGENTS CONTAINING MICROCAPSULES

The present invention relates to microcapsule formulations and to laundry detergent and cleaning product compositions comprising microcapsules containing a fragrance or perfume in their core.

The majority of laundry detergent and cleaning product compositions comprise fragrances or perfumes in order to give the compositions themselves or textiles or surfaces treated with them a pleasant fragrance. The fragrances or perfumes are mostly compounds having two or more conjugated double bonds, which are more or less sensitive to various chemicals or to oxidation. As a result, there may be unwanted interactions with other ingredients of the laundry detergents or cleaning products, such as surfactants or bleaches, for example, as a result of which the perfume is broken down and/or the odor note altered. A further problem is the sometimes high volatility of the fragrances or perfumes, as a result of which a large part of the quantity of perfume originally added to the laundry detergent or cleaning product has volatilized before the time of application. To overcome these problems it has already been proposed to incorporate the fragrances or perfumes in microencapsulated form into the laundry detergents or cleaning products.

For instance, U.S. Pat. No. 5,188,753 discloses a detergent composition comprising surface-active substances and perfume particles containing a perfume dispersed in a solid core of polyethylene, polyamide, polystyrene or the like, the particles being encapsulated within a friable coating made, for example, of urea-formaldehyde resins. When exposed to mechanical force, the capsules fracture and release the enclosed perfume.

EP-A-0 457 154 describes microcapsules obtainable by polymerization of monomers present together with a solvent and a free-radical initiator as the disperse phase of a stable oil-in-water emulsion, said polymerization being triggered by an increase in temperature.

EP-A-0 026 914 describes a process for preparing microcapsules by condensing melamine-formaldehyde precondensates and/or their $C_1$–$C_4$ alkyl ethers in water in which the material forming the capsule core is present in dispersion.

DE 199 32 144.2 relates to microcapsule formulations which comprise in their core a fragrance or perfume and whose polymeric shell may be destabilized by a change in pH, and to laundry detergents and cleaning products comprising the microcapsules.

EP 0 839 902 discloses microcapsules comprising bleaching assistants.

It is an object of the present invention to provide microcapsule formulations comprising fragrance or perfume, or laundry detergents or cleaning products comprising such microcapsules, where the mechanical stability of the capsule shell is selected so that during the washing or cleaning operation or the subsequent handling of the treated textiles or surfaces the microcapsules fracture and release their contents.

We have found that this object is achieved by microcapsules which comprise fragrance or perfume and whose capsule shell is obtainable by polymerization of acrylic monomers or by acid-induced condensation of melamine-formaldehyde precondensates and/or their $C_1$–$C_4$ alkyl ethers.

The invention accordingly provides a microcapsule formulation comprising microcapsules having a core of a hydrophobic material, which encloses at least one fragrance or perfume, and a capsule shell which is obtainable by either i) free-radical polymerization of ethylenically unsaturated monomers comprising:
   - from 30 to 100% by weight of one or more $C_1$–$C_{24}$ alkyl esters of acrylic and/or methacrylic acid,
   - from 0 to 70% by weight of a bi- or polyfunctional monomer,
   - from 0 to 40% by weight of other monomers; or ii) acid-induced condensation of melamine-formaldehyde precondensates and/or their $C_1$–$C_4$ alkyl ethers.

The average diameter of the microcapsules is preferably in the range from 1 to 100 $\mu$m, in particular from 3 to 50 $\mu$m. The ratio of wall thickness to the diameter of the microcapsules is preferably in the range from 0.005 to 0.1, in particular from 0.01 to 0.05.

The invention further provides a laundry detergent composition for textiles and a cleaning product composition for nontextile surfaces, such as skin or hair, which comprises said microcapsule formulation.

By a fragrance or perfume is meant any organic substance which has a desired olfactory property and is essentially nontoxic. Such substances include all fragrances or perfumes that are commonly used in perfumery or in laundry detergent or cleaning product compositions. The compounds involved may be natural, semisynthetic or synthetic in origin. Preferred fragrances or perfumes may be assigned to the classes of substance comprising the hydrocarbons, aldehydes or esters. The fragrances or perfumes also include natural extracts and/or essences, which may comprise complex mixtures of constituents, such as orange oil, lemon oil, rose extract, lavender, musk, patchouli, balsam essence, sandalwood oil, pine oil, and cedar oil.

Nonlimitative examples of synthetic and semisynthetic fragrances and perfumes are: 7-acetyl-1,2,3,4,5,6,7,8-octahydro-1,1,6,7-tetramethylnaphthalene, α-ionone, β-ionone, γ-ionone α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetralin, 4-acetyl-6-tert-butyl-1,1-dimethylindane, hydroxyphenylbutanone, benzophenone, methyl β-naphthyl ketone, 6-acetyl-1,1,2,3,3,5-hexamethylindane, 5-acetyl-3-isopropyl-1,1,2,6-tetramethylindane, 1-dodecanal, 4-(4-hydroxy-4-methylpentyl)-3-cyclohexene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal and methyl anthranilate, condensation products of hydroxycitronellal and indole, condensation products of phenylacetaldehyde and indole, 2-methyl-3-(para-tert-butylphenyl)propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethylcyclopenta-γ-2-benzopyran, β-naphthol methyl ether, ambroxane, dodecahydro-3*a*,6,6,9*a*-tetramethylnaphtho[2,1*b*]furan, cedrol, 5-(2,2,3-trimethylcyclopent-3-enyl)-3-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, and tert-butylcyclohexyl acetate.

Particular preference is given to the following: hexylcinnamaldehyde, 2-methyl-3-(tert-butylphenyl) propionaldehyde, 7-acetyl-1,2,3,4,5,6,7,8-octahydro-1,1,6, 7-tetramethylnaphthalene, benzyl salicylate, 7-acetyl-1,1,3,4,4,6-hexamethyltetralin, para-tert-butylcyclohexyl acetate, methyl dihydrojasmonate, β-naphthol methyl ether, methyl γ-naphthyl ketone, 2-methyl-2-(para-isopropylphenyl) propionaldehyde, 1,3,4,6,7,8-hexahydro-4,6,6,7,8,8-hexamethylcyclopenta-γ-2-benzopyran, dodecahydro-3*a*,6,6,9*a*-tetramethylnaphtho[2,1*b*]furan, anisaldehyde, coumarin, cedrol, vanillin, cyclopentadecanolide, tricyclodecenyl acetate and tricyclodecenyl propionates.

Other fragrances are essential oils, resinoids and resins from a large number of sources, such as, for example, Peru balsam, olibanum resinoid, styrax, labdanum resin, nutmeg, cassia oil, benzoin resin, coriander, and lavandin. Further suitable fragrances include: phenylethyl alcohol, terpineol, linalool, linalyl acetate, geraniol, nerol, 2-(1,1-dimethylethyl)cyclo-hexanol acetate, benzyl acetate, and eugenol.

The fragrances or perfumes can be used as single substances or in a mixture with one another. The fragrance or perfume may, as the sole hydrophobic material, form the core of the microcapsules. Alternatively, the microcapsules may in addition to the fragrance or perfume include a further hydrophobic material in which the fragrance or perfume is dissolved or dispersed. For example, when using fragrances or perfumes which are solid at room temperature, the use of a hydrophobic material which is liquid at room temperature, as a solvent or dispersant, is advantageous. Similarly, a further hydrophobic material may be added to the fragrance or perfume in order to increase its hydrophobicity.

The hydrophobic materials which can be used as core material in addition to the fragrance or perfume, include all types of oils, such as vegetable oils, animal oils, mineral oils, paraffins, chloroparaffins, fluorocarbons, and other synthetic oils. Typical examples are sunflower oil, rapeseed oil, olive oil, peanut oil, soybean oil, kerosene, benzene, toluene, butane, pentane, hexane, cyclohexane, chloroform, tetrachlorocarbon, chlorinated phenyls and silicone oils. High-boiling hydrophobic materials may also be used, for example diethyl phthalate, dibutyl phthalate, diisohexyl phthalate, dioctyl phthalate, alkylnaphthalenes, dodecylbenzene, terphenyl and partially hydrogenated terphenyls.

The hydrophobic material comprising or consisting of the fragrance or perfume is chosen so that it may be emulsified in water at temperatures between its melting point and the boiling point of water.

The fragrance or perfume, or the mixture of fragrances or perfumes, preferably accounts for from 1 to 100% by weight, in particular from 20 to 100% by weight, of the hydrophobic core material. The hydrophobic material is preferably liquid at 20° C.

In one embodiment of the invention, the capsule shell of the microcapsules in the microcapsule formulation of the invention is prepared by polymerizing ethylenically unsaturated monomers. The capsule shell is prepared by polymerizing from 30 to 100% by weight, preferably from 30 to 95% by weight (based in each case on the total weight of the monomers) of one or more $C_1$–$C_{24}$ alkyl esters, preferably $C_1$–$C_4$ alkyl esters, of acrylic and/or methacrylic acid. Examples are methyl acrylate, methyl methacrylate, ethyl acrylate, ethyl methacrylate, n-propyl acrylate, n-propyl methacrylate, isopropyl acrylate, isopropyl methacrylate, n-butyl acrylate, isobutyl acrylate, tert-butyl acrylate, n-butylmethacrylate, isobutyl methacrylate, tert-butyl methacrylate, cyclohexyl acrylate, cyclohexyl methacrylate, octyl acrylate, octyl methacrylate, 2-ethylhexyl acrylate, 2-ethylhexyl methacrylate, lauryl acrylate, lauryl methacrylate, stearyl acrylate, and palmityl acrylate.

From 0 to 70% by weight, preferably from 5 to 40% by weight, of the capsule shell is formed by bi- or polyfunctional monomers, i.e., di- or polyethylenically unsaturated compounds. Examples are acrylic and methacrylic esters derived from dihydric $C_2$–$C_{24}$ alcohols, e.g., ethylene glycol diacrylate, propylene glycol diacrylate, ethylene glycol dimethacrylate, propylene glycol dimethacrylate, 1,4-butanediol diacrylate, 1,4-butanediol dimethacrylate, 1,6-hexanediol diacrylate, and 1,6-hexanediol dimethacrylate, and also divinylbenzene, methallylmethacrylamide, allyl methacrylate, allyl acrylate, methylenebisacrylamide, trimethylolpropan triacrylate, trimethylolpropane trimethacrylate, pentaerythritol triallyl ether, pentaerythritol tetraacrylate and pentaerythritol tetramethacrylate.

From 0 to 40% by weight, preferably from 0 to 30% by weight, of the capsule shell may be composed of other monomers. These include, in particular, vinylaromatic compounds, such as styrene and α-methylstyrene, vinypyridine, vinyl esters of $C_1$–$C_{20}$ carboxylic acids, such as vinyl acetate and vinyl propionate; methacrylonitrile, methacrylamide, N-methylmethacrylamide, dimethylaminopropylmethacrylamide, dimethylaminoethyl acrylate, dimethylaminoethyl methacrylate, vinylcyclohexane, vinyl chloride, vinylidene chloride, 2-hydroxypropyl acrylate and 2-hydroxypropyl methacrylate.

There is preferably essentially no participation in the structure of the capsule shell by anionic monomers, such as acrylic acid or methacrylic acid, or cationic monomers, such as amino alkyl (meth)acrylates or aminoalkyl(meth) acrylamides. Moreover, there is preferably essentially no participation in the structure of the capsule shell by polyethylenically unsaturated monomers whose unsaturated sites are connected by way of successive chemical bonds of which at least one bond is acid- or base-hydrolyzable.

The microcapsules are obtainable by polymerizing the constituent monomer or monomer mixture of the capsule shell in the oil phase of a stable oil-in-water emulsion, the oil phase comprising the above-discussed hydrophobic material comprising at least one fragrance or perfume. This preparation process is known per se and is described, for example, in EP-A-0 457 154.

The core of the microcapsules is formed by the water-emulsifiable hydrophobic material. The hydrophobic material serves simultaneously as solvent or dispersant for the monomer mixture used in preparing the capsule shells by polymerization. The polymerization then takes place in the oil phase of a stable oil-in-water emulsion. This emulsion is obtained by, for example, first dissolving the monomers and a polymerization initiator, together, with if desired, a polymerization regulator, in the hydrophobic material and emulsifying the resulting solution in an aqueous medium with an emulsifier and/or protective colloid. Alternatively, the hydrophobic phase or constituents thereof may first be emulsified in the aqueous phase and then the monomers or the polymerization initiator, and any auxiliaries which it may also be desired to use, such as protective colloids or polymerization regulators, may be added to the emulsion. In another variant of the process, the hydrophobic material and the monomers may also be emulsified in water, with only the polymerization initiator being added subsequently. Since the hydrophobic material is to be microencapsulated as fully as possible in the emulsion, it is preferred to use only those hydrophobic materials whose solubility in water is limited. The solubility should preferably not exceed 5% by weight. For complete encapsulation of the hydrophobic material in the oil phase of the oil-in-water emulsion, it is judicious to select the monomers in accordance with their solubility in the hydrophobic material. While the monomers are essentially soluble in the oil, their polymerization in the individual oil droplets produces oligomers and polymers which are soluble neither in the oil phase nor in the water phase of the oil-in-water emulsion and which migrate to the interface between the oil droplets and the water phase. There, in the course of further polymerization, they form the wall material which ultimately encases the hydrophobic material core of the microcapsules.

In order to form a stable oil-in-water emulsion, it is common to use protective colloids and/or emulsifiers. Suitable protective colloids are, for example, cellulose derivatives, such as hydroxyethylcellulose, carboxymethylcellulose and methylcellulose, polyvinylpyrrolidone and copolymers of N-vinylpyrrolidone, polyvinyl alcohols, and partially hydrolyzed polyvinyl acetates. In addition, it is also possible to use gelatin, gum arabic, xanthan gum, alginates, pectins, degraded starches, and casein. Preference is given to the use of ionic protective colloids. Ionic protective colloids which may be cited include polyacrylic acid, polymethacrylic acid, copolymers of acrylic acid and methacrylic acid, sulfo-containing water-soluble polymers containing sulfoethyl acrylate, sulfoethyl methacrylate or sulfopropyl methacrylate, and polymers of N-(sulfoethyl) maleimide, 2-acrylamido-2-alkylsulfonic acids, styrenesulfonic acids and formaldehyde, and also condensates of phenolsulfonic acids and formaldehyde. The protective colloids are generally added in amounts of from 0.1 to 10% by weight, based on the water phase of the emulsion. The polymers used as ionic protective colloids preferably have average molecular masses of from 500 to 1,000,000, preferably from 1,000 to 500,000.

The polymerization takes place in general in the presence of polymerization initiators which form free radicals. For this purpose it is possible to use all customary peroxo compounds and azo compounds in the amounts normally employed, for example, from 0.1 to 5% by weight, based on the weight of the monomers to be polymerized. Preference is given to polymerization initiators which are soluble in the oil phase or in the monomers. Examples of these are t-butyl peroxyneodecanoate, t-butyl peroxypivalate, t-amyl peroxypivalate, dilauroyl peroxide, t-amyl peroxy-2-ethylhexanoate, and the like.

The polymerization of the oil-in-water emulsion is normally conducted at from 20 to 100° C., preferably from 40 to 90° C. Normally, the polymerization is performed under atmospheric pressure, but may also take place under reduced or increased pressure, for example, in the range from 0.5 to 20 bar. A judicious procedure is to emulsify a mixture of water, protective colloid and/or emulsifiers, hydrophobic materials, polymerization initiators and monomers to the desired droplet size of the hydrophobic material, using a high-speed disperser, and to heat the stable emulsion, with stirring, to the decomposition temperature of the polymerization initiator. The rate of the polymerization may be controlled in a known manner through the choice of temperature and through the choice of the amount of the polymerization initiator. On reaching the polymerization temperature, the polymerization is judiciously continued for a further period, for example, from 2 to 6 hours, in order to complete the conversion of the monomers.

Particular preference is given to a procedure in which the temperature of the polymerizing reaction mixture is increased continuously or periodically during the polymerization. This is done with the aid of a program with increasing temperature. For this purpose, the total polymerization time may be subdivided into two or more periods. The first polymerization period features slow decomposition of the polymerization initiator. In the second and any subsequent polymerization periods, the temperature of the reaction mixture is raised in order to accelerate the decompostion of the polymerization initiators. The temperature may be raised in one or more steps or continuously in a linear or nonlinear manner. The temperature difference between the beginning and the end of the polymerization may be up to 50° C. In general, the amount of this difference is from 3 to 40° C., preferably from 3 to 30° C.

Alternatively, the capsule shell of the microcapsules present in the microcapsule formulation of the invention may be prepared by acid-induced condensation of melamine-formaldehyde precondensates and/or their $C_1$–$C_4$ alkyl ethers in water in which the hydrophobic material forming the capsule core is present in dispersion, in the presence of a protective colloid. A process of this kind is known per se and is described, for example, in EP-A-0 026 914. The general procedure here is to emulsify the hydrophobic material to fine droplets in an aqueous solution of a protective colloid, said solution preferably having a pH of from 3 to 6.5. The aqueous solution of the melamine-formaldehyde precondensate and/or its $C_1$–$C_4$ alkyl ether is added with thorough mixing to the initial emulsion charge. At a temperature in the range from 20 to 100° C., preferably about 60° C., the microcapsules are formed. After the end of the addition, the condensation is completed. Alternatively, the capsules may be preformed at a temperature of from 20 to 50° C., preferably about 35° C., and then the temperature may be raised in order to cure the capsule wall. Heating to cure the capsule wall is at a temperature of at least 50° C., preferably from 75 to 95° C.

Suitable protective colloids include, in particular, polymers which carry sulfonic acid groups. These polymers preferably have a Fikentscher K value of from 100 to 170 or a viscosity of from 200 to 5000 mPa·s at 489 $s^{-1}$ (measured at 25° C. in 20% strength aqueous solution at a pH of 4.0 to 7.0). Preference is given to polymers having a K value of from 115 to 160 or to polymers whose viscosity is from 400 to 4000 mPa·s.

Examples of suitable water-soluble polymers which carry sulfonic acid groups are polymers of sulfoethyl (meth) acrylate, of sulfopropyl (meth)acrylate, of maleimido-N-ethanesulfonic acid, and of 2-acrylamido-2-methylpropanesulfonic acid. Polymers of 2-acrylamido-2-methylpropanesulfonic acid are preferred. The polymers are in the form of the free acid or, preferably, in the form of the alkali metal salts, especially the sodium salts. Suitable polymers which carry sulfonic acid groups, apart from the homopolymers of the abovementioned monomers, are copolymers which besides the abovementioned monomer which carries sulfonic acid groups contain $C_1$–$C_3$ alkyl acrylates, hydroxy-$C_2$–$C_4$ alkyl acrylates, such as methyl, ethyl, and propyl acrylate, hydroxypropyl acrylate and/or N-vinylpyrrolidone. In the case of the acrylates, their fraction in the copolymer is not more than 30% by weight. In the case of the hydroxyalkyl acrylates, their fraction should not be more than 10% by weight, based on the sum of the comonomers. In the case of N-vinylpyrrolidone copolymers, the fraction of monomers which carry sulfonic acid groups is at least 5% by weight, preferably at least 30% by weight. The homopolymers and copolymers which carry sulfonic acid groups are prepared by known processes.

The amount of protective colloid used is generally from 1 to 5.5% by weight, preferably from 1.5 to 4.5% by weight, based on the aqueous phase.

Suitable starting materials for the capsule shell comprise melamine-formaldehyde precondensates and/or their $C_1$–$C_4$ alkyl ethers, especially methyl ethers, having a molar ratio of melamine to formaldehyde of from 1:1.5 to 1:6, preferably from 1:3 to 1:6. Particular preference is given to methyl ether precondensates containing a molar melamine:formaldehyde:methanol ratio of from 1:3.0:2.0 to 1:6.0:4.0, in particular from 1:3.5:2.2 to 1:4.5:2.8. Preferably, the precondensates used are miscible with water in any proportion without producing any clouding.

The precondensates are generally condensed at a pH of from 3.0 to 6.5, preferably from 3.5 to 5.5. The pH of the aqueous phase may be adjusted with acid, preferably with formic acid.

The hydrophobic material is dispersed conventionally, by means of homogenizing or dispersing machines, for example, which may be provided with or without forced flow means. The capsule size may be controlled by way of the rotary speed of the dispersing or homogenizing apparatus and/or with the aid of the concentration of the protective colloid. As the rotary speed increases, the size of the disperse particles falls. As the viscosity of the aqueous phase increases or the viscosity of the core material falls, there is generally a decrease in the droplet size and thus in the size of the capsules.

It is important that the dispersing apparatus is used at the beginning of capsule formation. In the case of continuously operating apparatus with forced flow it is advantageous to pass the emulsion through the shear field a number of times. When the dispersed droplets have been encased by the wall material, the capsules are cured, preferably with stirring using normal stirrers, such as anchor, propeller or impeller stirrers. Otherwise there is a risk that the capsules will be broken in the shear field, owing to the high shear energy, and, because the condensation of the precondensate is already at an advanced stage, the holes can no longer be closed. Capsule formation and capsule size can easily be monitored under a light microscope. The as yet unencapsulated oil droplets rapidly coalesce under the cover glass on the slide. If the droplets are stable, a solid wall has already been deposited around them. The optimum conditions for each individual case, such as temperature, pH, stirrer, and the feed rate of the precondensate, may be determined readily on the basis of routine tests.

The capsules obtained by the above process may still contain residual free formaldehyde. The residual formaldehyde content may be bound by adding appropriate formaldehyde scavengers, such as ethyleneurea and/or melamine. Formaldehyde removal is advantageously conducted directly following final condensation (curing).

The microcapsule dispersions obtained by one of the procedures depicted above may subsequently be conventionally spray dried. To aid redispersion of the spray-dried microcapsules, additional amounts of emulsifier and/or protective colloid may be added, if desired, to the dispersions prior to spray drying. Suitable emulsifiers and/or protective colloids are those mentioned above in connection with the preparation of the microcapsule dispersion. In general, the aqueous microcapsule dispersion is atomized in a stream of hot air which is guided in cocurrent or countercurrent, preferably in cocurrent, with the spray mist. The entry temperature of the hot air stream is usually in the range from 100 to 200° C., preferably from 120 to 160° C., and the exit temperature of the air stream is generally in the range from 30 to 90° C., preferably from 60 to 80° C. The aqueous microcapsule dispersion may be sprayed, for example, using single-fluid or multi-fluid nozzles or a rotating disk. The spray-dried microcapsule formulations are normally deposited using cyclones or filter separators. The liquid or spray-dried microcapsule formulations may be used to formulate laundry detergents or cleaning products.

The laundry detergents and cleaning products of the invention may be in liquid or solid form. In addition to the microcapsule formulations of the invention, they generally comprise further customary constituents. The customary constituents of laundry detergents for textiles include, inter alia, bleaches, bleach activators, builders, i.e., inorganic builders and/or organic cobuilders, surfactants, especially anionic and/or nonionic surfactants. Further auxiliaries and co-components are standardizing agents, complexing agents, phosphates, dyes, corrosion inhibitors, grayness inhibitors (antiredeposition agents) and/or soil release polymers, color transfer inhibitors, bleaching catalysts, peroxide stabilizers, electrolytes, optical brighteners, enzymes, unencapsulated perfume oils, foam regulators, and activating substances. The selection of appropriate auxiliaries is within the expertise of the skilled worker. In the present case, the laundry detergents also include textile aftertreatment compositions, such as fabric softeners, impregnated nonwovens which are placed in the dryer together with the wet laundry, and laundry additives which are added separately from the dispersion.

Suitable inorganic builder substances are all customary inorganic builders such as aluminosilicates, silicates, carbonates, and phosphates.

Examples of suitable inorganic builders are alumosilicates having ion exchange properties, such as zeolites, for example. Various types of zeolite are suitable, especially zeolite A, X, B, P, MAP and HS in their Na form or in forms in which some of the Na has been replaced by other cations such as Li, K, Ca, Mg, or ammonium. Suitable zeolites are described, for example, in EP-A 0 038 591, EP-A 0 021 491, EP-A 0 087 035, U.S. Pat. No. 4,604,224, GB-A 20 13 259, EP-A 0 522 726, EP-A 0 384 070 and WO-A-94/24 251.

Examples of further suitable inorganic builders are amorphous or crystalline silicates, such as amorphous disilicates, crystalline disilicates, such as the sheet silicate SKS-6 (manufacturer: Hoechst). The silicates may be used in the form of their alkali metal, alkaline earth metal or ammonium salts. Preference is given to the use of Na, Li and Mg silicates.

Examples of suitable anionic surfactants are fatty alcohol sulfates of fatty alcohols having 8 to 22, preferably 10 to 18, carbon atoms, e.g., $C_9$–$C_{11}$, alcohol sulfates, $C_{12}$–$C_{13}$ alcohol sulfates, cetyl sulfate, myristyl sulfate, palmityl sulfate, stearyl sulfate, and tallow fatty alcohol sulfate.

Further suitable anionic surfactants are sulfated ethoxylated $C_8$–$C_{22}$ alcohols (alkyl ether sulfates) and their soluble salts. Compounds of this kind are prepared, for example, by first alkoxylating a $C_8$–$C_{22}$, preferably a $C_{10}$–$C_{18}$, alcohol, e.g., a fatty alcohol, and then sulfating the alkoxylation product. For the alkoxylation it is preferred to use ethylene oxide, with from 2 to 50, preferably from 3 to 20, mol of ethylene oxide being used per mole of fatty alcohol. Alternatively, the alcohols may be alkoxylated with propylene oxide alone and, if desired, with butylene oxide. Also suitable, moreover, are alkoxylated $C_8$–$C_{22}$ alcohols containing ethylene oxide and propylene oxide or ethylene oxide and butylene oxide. The alkoxylated $C_8$ or up to $C_{22}$ alcohols may contain the ethylene oxide, propylene oxide and butylene oxide units in the form of blocks or in random distribution.

Further suitable anionic surfactants are alkanesulfonates, such as $C_8$–$C_{24}$, preferably $C_{10}$–$C_{18}$, alkanesulfonates, and also soaps, such as the salts of $C_8$–$C_{24}$ carboxylic acids, for example.

Further suitable anionic surfactants are $C_9$–$C_{20}$ linear alkylbenzenesulfonates (LAS).

The anionic surfactants are added to the laundry detergent preferably in the form of salts. Suitable salts are alkali metal salts, such as sodium, potassium and lithium salts, and ammonium salts, such as hydroxyethylammonium, di(hydroxyethyl)ammonium, and tri(hydroxyethyl) ammonium salts, for example.

Examples of suitable nonionic surfactants are alkoxylated $C_8$–$C_{22}$ alcohols, such as fatty alcohol alkoxylates or oxo alcohol alkoxylates. The alkoxylation may be carried out with ethylene oxide, propylene oxide and/or butylene oxide. As surfactant in this case it is possible to use all alkoxylated alcohols which contain at least two molecules of an abovementioned alkylene oxide in the adduct. Also suitable in this case are block polymers of ethylene oxide, propylene oxide and/or butylene oxide, or adducts which contain said alkylene oxides in random distribution. From 2 to 50, preferably from 3 to 20, mol of at least one alkylene oxide are used per mole of alcohol. The alkylene oxide used is preferably ethylene oxide. The alcohols preferably have 10 to 18 carbon atoms.

A further class of suitable nonionic surfactants comprises alkylphenol ethoxylates having $C_6$–$C_{14}$ alkyl chains and from 5 to 30 mol of ethylene oxide units.

Another class of nonionic surfactants comprises alkyl polyglucosides having 8 to 22, preferably 10 to 18, carbon atoms in the alkyl chain. These compounds usually contain from 1 to 20, preferably from 1.1 to 5, glucoside units. Another class of nonionic surfactants are the N-alkylglucamides.

The laundry detergents of the invention preferably comprise $C_{10}$–$C_{16}$ alcohols ethoxylated with from 3 to 12 mol of ethylene oxide, and with particular preference ethoxylated fatty alcohols, as nonionic surfactants.

Examples of suitable low molecular mass polycarboxylates as organic cobuilders are the following:

$C_4$–$C_{20}$ di-, tri- and tetracarboxylic acids, such as succinic acid, propanetricarboxylic acid, butanetetracarboxylic acid, cyclopentanetetracarboxylic acid, and alkylsuccinic and alkylenesuccinic acids having $C_2$–$C_{16}$ alkyl or alkylene radicals, respectively;

$C_4$–$C_{20}$ hydroxy carboxylic acids, such as malic acid, tartaric acid, gluconic acid, glutaric acid, citric acid, lactobionic acid and sucrose mono-, di- and tricarboxylic acids;

amino polycarboxylates, such as nitrilotriacetic acid, methylglycinediacetic acid, alaninediacetic acid, ethylenediaminetetraacetic acid, and serinediacetic acid;

salts of phosphonic acids, such as hydroxyethanediphosphonic acid, ethylenediaminetetra(methylenephosphonate), and diethylenetriaminepenta(methylenephosphonate).

Examples of suitable oligomeric or polymeric polycarboxylates as organic cobuilders are the following:

oligomaleic acids, as described, for example, in EP-A 0 451 508 and EP-A 0 396 303;

copolymers and terpolymers of unsaturated $C_4$–$C_8$ dicarboxylic acids, possible comonomers present in comonomerized form being monoethylenically unsaturated monomers from group (i) in amounts of up to 95% by weight, from group (ii) in amounts of up to 60% by weight, and from group (iii) in amounts of up to 20% by weight.

Examples of suitable unsaturated $C_4$–$C_8$ dicarboxylic acids in this context are maleic acid, fumaric acid, itaconic acid, and citraconic acid. Maleic acid is preferred.

Group (i) embraces monoethylenically unsaturated $C_3$–$C_8$ monocarboxylic acids, such as acrylic acid, methacrylic acid, crotonic acid, and vinylacetic acid. Acrylic acid and methacrylic acid are preferably used from group (i).

Group (ii) embraces monoethylenically unsaturated $C_2$–$C_{22}$ olefins, vinyl alkyl ethers containing $C_1$–$C_8$ alkyl groups, styrene, vinyl esters of $C_1$–$C_8$ carboxylic acid, (meth)acrylamide, and vinylpyrrolidone. $C_2$–$C_6$ olefins, vinyl alkyl ethers containing $C_1$–$C_4$ alkyl groups, vinyl acetate and vinyl propionate are preferably used from group (ii).

Group (iii) embraces (meth)acrylic esters of $C_1$–$C_8$ alcohols, (meth)acrylonitrile, (meth)acrylamides, (meth) acrylamides of $C_1$–$C_8$ amines, N-vinylformamide, and vinylimidazole.

If the polymers contain copolymerized vinyl ester of group (ii), some or all of said ester may also be present in hydrolyzed form as vinyl alcohol structural units. Appropriate copolymers and terpolymers are known, for example, from U.S. Pat. No. 3,887,806 and SE-A 43 13 909.

Copolymers of dicarboxylic acids that are suitable as organic cobuilders are preferably the following:

copolymers of maleic acid and acrylic acid in a weight ratio of from 10:90 to 95:5, with particular preference both in a weight ratio of from 30:70 to 90:10 with molecular masses of from 10 000 to 150 000;

terpolymers of maleic acid, acrylic acid and a vinyl ester of $C_1$–$C_3$ carboxylic acid in a weight ratio of from 10 (maleic acid):90 (acrylic acid+vinyl ester) to 95 (maleic acid):10 (acrylic acid+vinyl ester), it being possible for the weight ratio of acrylic acid to vinyl ester to vary within the range from 20:80 to 80:20, and with particular preference terpolymers of maleic acid, acrylic acid and vinyl acetate or vinyl propionate in a weight ratio of from 20 (maleic acid):80 (acrylic acid+vinyl ester) to 90 (maleic acid):10 (acrylic acid+vinyl ester), it being possible for the weight ratio of acrylic acid to the vinyl ester to vary within the range from 30:70 to 70:30;

copolymers of maleic acid with $C_2$–$C_8$ olefins in a molar ratio from 40:60 to 80:20, particular preference being given to copolymers of maleic acid with ethylene, propylene or isobutene in a molar ratio of 50:50.

Graft polymers of unsaturated carboxylic acids on low molecular mass carbohydrates or hydrogenated carbohydrates—cf. U.S. Pat. No. 5,227,446, DE-A 44 15 623, DE-A 43 13 909—are likewise suitable as organic cobuilders.

Examples of suitable unsaturated carboxylic acids in this respect are maleic acid, fumaric acid, itaconic acid, citraconic acid, acrylic acid, methacrylic acid, crotonic acid and vinylacetic acid, and also mixtures of acrylic acid and maleic acid, which are grafted on in amounts of from 40 to 95% by weight, based on the component to be grafted.

For the purpose of modification it is possible in addition for up to 30% by weight, based on the component to be grafted, of further monoethylenically unsaturated monomers to be present in copolymerized form. Suitable modifying monomers are the abovementioned monomers of groups (ii) and (iii).

Suitable graft bases include degraded polysaccharides, such as acidic or enzymatically degraded starches, inulins or cellulose, reduced (hydrogenated or reductively aminated) degraded polysaccharides, such as mannitol, sorbitol, aminosorbitol and glucamine, for example and also polyalkylene glycols with molecular masses up to $M_w$=5 000, such as polyethylene glycols, ethylene oxide/propylene oxide and ethylene oxide/butylene oxide block copolymers, random ethylene oxide/propylene oxide and/or ethylene oxide/butylene oxide copolymers, and alkoxylated monhydric or polyhydric $C_1$–$C_{22}$ alcohols, for example; U.S. Pat. No. 4,746,456.

From this group, it is preferred to use grafted degraded or degraded reduced starches and grafted polyethylene oxides, with from 20 to 80% by weight of monomers, based on the grafting component, being used in the graft polymerization. For grafting it is preferred to use a mixture of maleic acid and acrylic acid in a weight ratio of from 90:10 to 10:90.

Polyglyoxylic acids as organic cobuilders are described, for example, in EP-B 0 001 004, U.S. Pat. No. 5,399,286, DE-A 41 06 355 and EP-A 0 656 914. The end groups of the polyglyoxylic acids may have different structures.

Polyamidocarboxylic acids and modified polyamidocarboxylic acids as organic cobuilders are known, for example, from EP-A 0 454 126, EP-B 0 511 037, WO-A 94/01486 and EP-A 0 581 452.

Other compounds suitable as organic cobuilders are polyaspartic acid or cocondensates of aspartic acid with other amino acids, $C_4$–$C_{25}$ mono- or dicarboxylic acids and/or $C_4$–$C_{25}$ mono- or diamines. Particular preference is given to the use of polyaspartic acids prepared in phosphorus acids and modified with $C_6$–$C_{22}$ monocarboxylic or dicarboxylic acids and/or with $C_6$–$C_{22}$ monoamines or diamines.

Condensation products of citric acid with hydroxy carboxylic acids or polyhydroxy compounds as organic cobuilders are known, for example, from WO-A 93/22362 and WO-A 92/16493. Carboxyl-containing condensates of this kind usually have molecular masses of up to 10 000, preferably up to 5 000.

Examples of suitable soil release polymers and/or grayness inhibitors for laundry detergents are the following:

polyesters made from polyethylene oxides with ethylene glycol and/or propylene glycol and aromatic dicarboxylic acids or aromatic and aliphatic dicarboxylic acids;

polyesters made from polyethylene oxides which are end group-capped at one end and dihydric and/or polyhydric alcohols and dicarboxylic acid. Polyesters of this kind are known, for example, from U.S. Pat. No. 3,557,039, GB-A 11 54 730, EP-A 0 185 427, EP-A 0 241 984, EP-A 0 241 985, EP-A 0 272 033 and U.S. Pat. No. 5,142,020.

Further suitable soil release polymers are amphiphilic graft polymers or copolymers of vinyl and/or acrylic esters on polyalkylene oxides (cf. U.S. Pat. No. 4,746,456, U.S. Pat. No. 4,846,995, DE-A 37 11 299, U.S. Pat. No. 4,904,408, U.S. Pat. No. 4,846,994 and U.S. Pat. No. 4,849,126) or modified celluloses, such as methylcellulose, hydroxypropylcellulose or carboxymethylcellulose, for example.

Examples of color transfer inhibitors used are homopolymers and copolymers of vinylpyrrolidone, of vinylimidazole, of vinyloxazolidone and of 4-vinylpyridin-N-oxide, having molecular masses of from 15 000 to 100 000, and also crosslinked, finely divided polymers based on these monomers. This use of such polymers is known; cf. DE-B 22 32 353, DE-A 28 14 287, DE-A 28 14 329 and DE-A 43 16 023.

Suitable enzymes are proteases, lipases, amylases, and cellulases. The enzyme system may be confined to a single one of the enzymes or may comprise a combination of different enzymes.

The microcapsules of the invention containing perfumes and odorants are used preferably in powder or granule laundry detergents and in laundry detergent tablets. These may be conventional heavy duty detergents, or detergent concentrates or compacts.

A typical (heavy duty) powder or granule laundry detergent of the invention, containing perfumes and odorants in microcapsules, may have the following exemplary composition:

from 0.5 to 50% by weight, preferably from 5 to 30% by weight, of at least one anionic and/or nonionic surfactant, the detergent formulation containing preferably not more than 8% by weight of LAS, with particular preference not more than 4% by weight of LAS, from 0.5 to 60% by weight, preferably from 15 to 40% by weight, of at least one inorganic builder, from 0 to 20% by weight, preferably from 0.5 to 8% by weight, of at least one organic cobuilder, from 0 to 35% by weight, preferably from 5 to 30% by weight, of perborate or percarbonate, from 0.001 to 2% by weight, preferably from 0.01 to 0.5% by weight, of microcapsules of the invention, from 0 to 5% by weight, preferably from 0 to 2.5% by weight, of a polymeric color transfer inhibitor, from 0 to 1.5% by weight, preferably from 0.01 to 1.0% by weight, of protease, from 0 to 1.5% by weight, preferably from 0.01 to 1.0% by weight, of other laundry detergent enzymes, from 0 to 1.5% by weight, preferably from 0.2 to 1.0% by weight, of a soil release polymer and/or grayness inhibitor, and customary auxiliaries and water to 100%.

The laundry detergents of the invention may have different bulk densities in the range from 300 to 1200 g/l, in particular from 500 to 950 g/l. Modern compact detergents generally possess high bulk densities and have a granular composition.

Cleaning products of the invention may be present in the form of a hand or machine dishwashing composition, shampoos, bath additives, all-purpose cleaners for nontextile surfaces comprising, for example, metal, painted or varnished wood or plastic, or cleaning products for ceramic articles, such as porcelain and tiles. As well as the microcapsule formulation, cleaning products of the invention normally include surfactants, e.g., anionic or nonionic surfactants, solubilizers, polymeric cleaning enhancers, dyes, unencapsulated fragrances, and other customary additives. A review of this topic is given, for example, in HAPPI, June 1988, p. 78 (B. Milwidsky).

Cleaning products can be formulated as liquids, pastes, foams, or solids. Machine dishwashing compositions, for example, are usually formulated as powders, granules, or tablets. Powder formulations are also encountered with abrasive scouring compositions.

Normally, the compositions are sold in the form of aqueous concentrates which are used neat or diluted.

Typical examples of anionic surfactants employed in cleaning products are the following:

alkylbenzenesulfonates, alkanesulfonates, olefinsulfonates, alkyl ether sulfonates, glycerol ether sulfonates, α-methyl ester sulfonates, sulfo fatty acids, alkyl sulfates, fatty alcohol ether sulfates, glycerol ether sulfates, mixed hydroxy ether sulfates, monoglyceride (ether) sulfates, fatty acid amide (ether) sulfates, sulfosuccinates, sulfosuccinamates, sulfotriglycerides, amide soaps, ether carboxylic acids, isethionates, sarcosinates, taurides, alkyl oligoglucoside sulfates, alkyl (ether) phosphates, hydroxyalkylsarcosinates.

Typical examples of nonionic surfactants are the following: fatty acid amide polyglycol ethers, fatty and oxo alcohol polyglycol ethers, alkylphenol polyglycol ethers, fatty acid polyglycol esters, fatty acid amide polyglycol ethers, fatty amine polyglycol ethers, alkoxylated triglycerides, block copolymers of ethylene oxide and propylene oxide and/or butylene oxide. Where the nonionic surfactants containing polyglycol ether chains, they may have a conventional or, preferably, a narrowed homologue distribution.

Typical examples of cationic surfactants are quaternary ammonium compounds and quaternized difatty acid trialkanolamine esters (ester quats).

Typical examples of amphoteric, or zwitterionic, surfactants are alkyl betaines, alkylamido betaines, aminopropionates, aminoglycinates, imidazolinium betaines, and sulfo betaines.

An overview of appropriate surfactants can be found, for example, in J. Falbe (Ed.), "Surfactants in Consumer Products", Springer Verlag, Berlin 1987, pp. 54–124. Further suitable surfactants for cleaning formulations are the surfactants described above for laundry detergents. The surfactants are present in amounts of from 2.5 to 90% by weight, preferably from 25 to 75% by weight, based on the active substance content. The cleaning products are normally aqueous solutions having an active substance content of from 2 to 50% by weight, preferably from 5 to 25% by weight.

Builder substances: For the cleaning products of the invention, builders used are in their entirety alkaline, organic or inorganic compounds, especially organic and/or inorganic complexing agents, which are preferably in the form of their alkali metal salts and/or amine salts and, in particular, in the form of their sodium salts and/or potassium salts. Also suitable for use in cleaner formulations are all of the builders and cobuilders described above for laundry detergents. Here, the builders also include the alkali metal hydroxides.

Suitable inorganic complexing builders, in addition to polyphosphates, are zeolites, bicarbonates, borates, silicates, or orthophosphates of the alkali metals.

The organic complexing agents of the aminopolycarboxylic acid type include, inter alia, nitrilotriacetic acid, ethylenediaminetetraacetic acid, N-hydroxyethylethylenediamineacetic acid, and polyalkylenepolyamine-N-polycarboxylic acids. Examples of diphosphonic and polyphosphonic acids that may be mentioned include the following: methylenediphosphonic acid, 1-hydroxyethane-1,1-diphosphonic acid, propane-1,2,3-triphosphonic acid, butane-1,2,3,4-tetraphosphonic acid, polyvinylphosphonic acid, copolymers of vinylphosphonic acid and acrylic acid, ethane-1,2-dicarboxy-1,2-diphosphonic acid, phosphonosuccinic acid, 1-aminoethan-1,2-diphosphonic acid, aminotri(methylenephosphonic acid), methylamino- or ethylamino-di (methylenephosphonic acid), and ethylenediaminetetra (methylenephosphonic acid).

Proposed examples of N-free or P-free polycarboxylic acids or their salts as builders are in many cases, although not exclusively, compounds containing carboxyl groups. A large number of these polycarboxylic acids possess complexing properties for calcium. They include, for example, citric acid, tartaric acid, benzenehexacarboxylic acid, tetrahydrofurantetracarboxylic acid, glutaric acid, succinic acid, adipic acid, and mixtures thereof.

Cleaning intensifiers may be selected from the group consisting of water-soluble substances of high molecular mass, such as polyvinyl alcohol, polyvinylpyrrolidone, polyalkylene glycol, and carboxymethylcellulose.

pH regulators: Since many household cleaning products are generally formulated to be neutral to weakly alkaline, i.e., their aqueous solution use forms have a pH in the range from 7.0 to 10.5, preferably from 7.0 to 9.5, at use concentrations of from 2 to 20 g/l, preferably from 5 to 15 g/l water or aqueous solution, the addition of acidic or alkaline components, respectively, may be necessary in order to regulate the pH.

Suitable acidic substances are customary organic or inorganic acids or acidic salts, such as hydrochloric acid, sulfuric acid, bisulfates or alkalis, aminosulfonic acid, phosphoric acid or glutaric acid, succinic acid, adipic acid, or mixtures thereof, for example.

Solvents and solubilizers, such as lower aliphatic alcohols having 1 to 4 carbon atoms (especially ethanol), alkylarylsulfonates (especially toluene-, xylene- and/or cumenesulfonate) and lower alkyl sulfates (especially octyl sulfate and 2-ethylhexyl sulfate). Further solubilizers which can be used are water-soluble organic solvents, especially those having boiling points above 75° C., such as ethers of identical or different polyhydric alcohols, especially butyl diglycol, and also the partial ethers of ethylene glycol, propylene glycol, butylene glycol or glycerol with aliphatic $C_1$ to $C_6$ alcohols.

Suitable water-soluble or water-emulsifiable organic solvents also include ketones, such as acetone and methyl ethyl ketone, and aliphatic and cycloaliphatic hydrocarbons or terpene alcohols. The weight ratio of surfactant to solvent or solubilizer may be from 1:0 to 5:1, preferably from 1.5:1 to 3.5:1.

In order to regulate the viscosity it may be advisable to add higher polyglycol ethers having molecular weights of up to about 600, or oligoglycerol mixtures. For thickening, consideration may also be given to adding electrolyte salts, such as sodium chloride and/or magnesium chloride. The cleaning compositions may further include additions of dyes and fragrances, preservatives, etc.

The microcapsules of the invention may be employed, furthermore, in the following products: rinse and aftertreatment products for textiles, leather, wood and floors with tiles, stone, linoleum or PVC coverings, and cleaning products for carpets, rugs, and upholstered furniture.

The invention is illustrated by the following example:

In a cylindrical 4 l stirring vessel with a built-in toothed-disk stirrer (5 cm diameter), 908 g of water and 200 g of a 20% solution of poly-2-acrylamidomethylpropanesulfonic acid, sodium salt (viscosity: 770 mPa.s, K value 123) are mixed, and the mixture is adjusted to a pH of 4.5 using formic acid and heated to 60° C. Then, at a rotary speed of 4500 rpm, an oil phase comprising 435 g of liquid paraffin and 400 g of a pine fragrance mixture are dispersed in the aqueous solution. The colorless dispersion obtained is then admixed over the course of 60 minutes, at a uniform rate, with a solution of 120 g of a partially methylated precondensate (contains about 2.3 $CH_3O$ groups per melamine molecule) or 1 mol of melamine in 5.25 mol of formaldehyde in 132 g of water, said solution having been adjusted to a pH of 4.5, at 60° C. After a total of 65 minutes, the resultant microcapsule dispersion is stirred at 60° C. for a further 3.5 h using a propeller stirrer (500 rpm). The dispersion is then cooled, adjusted to a pH of 7.0 and sieved through a sieve having a mesh size of 40 $\mu$m, producing a residue of 1 g of solid. The dispersion obtained is milky white and is found by microscopic assessment to contain individual capsules whose diameter is predominantly from 3 to 6 $\mu$m.

The microcapsule dispersion is drawn down onto a piece of paper using a coating bar, such that after drying there are about 5 g of the microcapsule formulation per $m^2$ on the paper. The paper has only a little of the fragrance odor. By vigorous rubbing with the finger, the microcapsules are destroyed in one area of the paper, and a strong pine fragrance is perceived in this area. The microcapsules have been destroyed mechanically.

We claim:

1. A microcapsule formulation comprising:

microcapsules having a core of a hydrophobic material, at least one fragrance or perfume, which is contained in the core of hydrophobic material, and a capsule shell, wherein the ratio of the capsule shell thickness to the diameter of the microcapsules is in the range of 0.005 to 0.1;

wherein said microcapsule formulation is obtained by:

a) dissolving an ethylenically unsaturated monomer comprising:
   from 30 to 100% by weight of one or more $C_1$–$C_{24}$ alkyl esters of acrylic and/or methacrylic acid,
   from 0 to 70% by weight of a bi- or polyfunctional monomer,
   from 0 to 40% by weight of other monomers; and
   a polymerization initiator in the hydrophobic material, b) emulsifying the resulting solution in an aqueous medium to obtain an oil-in-water emulsion;

c) heating the emulsion to the decomposition temperature of the polymerization initiator, thereby inducing free-radical polymerization of the monomer to produce a polymer which is soluble neither in the oil phase nor in the water phase of the oil-in-water-emulsion and which migrates to the interphase between the oil droplets in the water phase and ultimately encases the hydrophobic material core of the microcapsules.

2. The microcapsule formulation of claim 1, wherein the hydrophobic material is liquid at 20° C.

3. The microcapsule formulation of claim 1, wherein the hydrophobic material is an oil, paraffin, chloroparaffin, or fluorocarbon.

4. The microcapsule formulation of claim 1, wherein the hydrophobic material is selected from the group consisting of at least one sunflower oil, rapeseed oil, olive oil, peanut oil, soybean oil, kerosene, benzene, toluene, butane, pentane, hexane, cyclohexane, chloroform, tetrachiorocarbon, chlorinated phenyl, silicone oil, diethyl phthalate, dibutyl phthalate, diisohexyl phthalate, dioctyl phthalate, alkyl naphthalene, dodecylbenzene, terphenyl, and partially hydrogenated terphenyl.

5. The microcapsule formulation of claim 1, wherein the fragrance is hexylcinnamaldehyde, 2-methyl-3-(tert-butylphenyl)-propionaldehyde, 7-acetyl-1,2,3,4,5,6,7,8-octahydro-1,1,6,7-tetramethylnaphthalene, benzyl salicylate, 7-acetyl-1,1,3,4,4,6-hexamethyltetralin, para-tert-butylcyclohexyl acetate, methyl dihydrojasmonate, β-naphthol methyl ether, methyl β-naphthyl ketone, 1,3,4,6,7,8-hexahydro-4,6,6,7,8,8-hexamethylcyclopenta-γ-2-benzopyran, dodecahydro-3a,6,6,9a-tetramethylnaphthol[2,1b]furan, anisaldehyde, coumarin, cedrol, vanillin, cyclopentadecanolide, tricyclodecenyl acetate and tricyclodecenyl propionate.

6. The microcapsule formulation of claim 1, wherein the fragrance comprises at least one fragrance selected from the group consisting of Peru balsam, olibanum resinoid, styrax, labdanum resin, nutmeg, cassia oil, benzoin resin, coriander, lavandin, phenylethyl alcohol, terpineol, linalool, linalyl acetate, geraniol, nerol, 2-(1,1-dimethylethyl)cyclohexanol acetate, benzyl acetate, and eugenol.

7. The microcapsule formulation of claim 1, wherein the capsule shell is obtained by polymerizing from 30 to 95% by weight of one or more $C_1$–$C_{24}$ alkyl esters of acrylic and/or methacrylic acid, from 5 to 40% by weight of a bi- or polyfunctional monomer, and from 0 to 30% by weight of other monomers.

8. The microcapsule formulation of claim 1, wherein step b) is carried out in the presence of protective colloid.

9. The microcapsule formulation of claim 1, wherein the ratio of the capsule shell thickness to the diameter of the microcapsules is in the range of 0.01 to 0.05.

10. The microcapsule formulation of claim 1, wherein the average diameter of the microcapsules is in the range from 1 to 100 μm.

11. The microcapsule formulation of claim 1, wherein the average diameter of the microcapsules is in the range from 3 to 50 μm.

12. A composition comprising the microcapsule formulation of claim 1, and one or more surfactant(s) or builder(s).

13. A composition comprising the microcapsule formulation of claim 1, and one or more bleach(es) or bleach activator(s).

14. A composition comprising the microcapsule formulation of claim 1, and one or more stardardizing agent(s), complexing agent(s), phosphate(s), dye(s), corrosion inhibitor(s), grayness inhibitor(s), soil release polymer(s), color transfer inhibitor(s), bleach stabilizer(s), peroxide stabilizer(s), electrolyte(s), optical brightener(s), enzyme(s), foam regulator(s), pH regulator(s), or viscosity regulator(s).

15. A composition comprising the microcapsule formulation of claim 1 which is formulated as a laundry detergent or as a cleaning product for textiles.

16. A composition comprising the microcapsule formulation of claim 1 which is formulated as a cleaning product for non-textile surfaces.

17. A process for preparing the microcapsule formulation of claim 1, comprising:

emulsifing in water a hydrophobic material comprising at least one fragrance or perfume with ethylenically unsaturated monomers, which monomers comprise: from 30 to 100% by weight of one or more $C_1$–$C_{24}$ alkyl esters of acrylic and/or methacrylic acid, from 0 to 70% by weight of a bi- or polyfunctional monomer, and from 0 to 40% by weight of other monomers, adding at least one polymerization initiator, and heating the mixture to the thermal decomposition of the polymerization initiator.

18. The process of claim 17 further comprising adding a protective colloid to said mixture.

19. The process of claim 17, futher comprising adding a protective colloid to said mixture, wherein said protective colloid has a Fikentscher K value ranging from 100 to 170 or a viscosity ranging from 200 to 5,000 mPa·s at 489 $s^{-1}$.

20. The process of claim 17, futher comprising adding at least one emulsifier to said mixture.

* * * * *